US005323710A

United States Patent [19]

Manström

[11] Patent Number: 5,323,710

[45] Date of Patent: Jun. 28, 1994

[54] FORWARDLY AND REARWARDLY SELF-ADJUSTING ARRANGEMENT FOR DRIVING A TRACKBOUND TOWING UNIT

[75] Inventor: Hilding Manström, Lulea, Sweden

[73] Assignee: Svenska Kraftbyggarna Entreprenad AB, Lulea, Sweden

[21] Appl. No.: 923,883

[22] PCT Filed: Feb. 25, 1991

[86] PCT No.: PCT/SE91/00145

§ 371 Date: Oct. 23, 1991

§ 102(e) Date: Oct. 23, 1992

[87] PCT Pub. No.: WO91/12982

PCT Pub. Date: Sep. 5, 1991

[30] Foreign Application Priority Data

Feb. 27, 1990 [SE] Sweden ..... 9000701

[51] Int. Cl.[5] ..... B61C 11/00

[52] U.S. Cl. ..... 105/30; 105/199.1; 105/199.2

[58] Field of Search ..... 105/30, 72.2, 145, 177, 105/180, 199.1, 199.2, 215.1; 104/120

[56] References Cited

U.S. PATENT DOCUMENTS

| | | | |
|---|---|---|---|
| 645,648 | 3/1900 | Morgan | 105/30 |
| 720,291 | 2/1903 | Smith | 105/30 |
| 2,310,223 | 4/1943 | Cheneau | 105/30 |
| 3,240,291 | 3/1966 | Bingham | 105/145 X |
| 3,456,597 | 7/1969 | Jackson | 105/30 |
| 3,673,966 | 7/1972 | Wilson | 105/30 X |

FOREIGN PATENT DOCUMENTS

| | | | |
|---|---|---|---|
| 873613 | 3/1953 | Fed. Rep. of Germany | 105/145 |
| 1022080 | 3/1966 | United Kingdom | 105/30 |

*Primary Examiner*—Robert J. Oberleitner
*Assistant Examiner*—S. Joseph Morano
*Attorney, Agent, or Firm*—Cushman Darby & Cushman

[57] ABSTRACT

An arrangement for driving a trackbound traction unit and being self-adjusting in both the forward and rearward directions. The arrangement includes at least two drive wheels with associated transmissions, two carrier arms whose longitudinal axes substantially parallel with the longitudinal direction of the traction unit and on one end of which the drive wheels are journalled, a holder in which the other end of the carrier arms is pivotally journalled by means of spherical bearings, a hydraulic piston-cylinder device which is connected to the first-mentioned ends of the carrier arms, and a rail which is fixedly mounted to the chassis in the center of the track. The carrier arms are substantially perpendicular to the geometric axes of the drive wheels and are intended to swing the drive wheels into pressured abutment with the center rail through the medium of the hydraulic piston-cylinder device. The arrangement includes a substantially elongated rectangular frame from which the holder projects, resilient devices from which the frame is pivotally suspensed on the chassis of the traction unit, coupling devices for resilient coaction between the frame and the chassis, and hydraulic holding piston-cylinder devices for mutually the coupling the coupling devices when the traction unit is driven.

10 Claims, 4 Drawing Sheets

FORWARDLY AND REARWARDLY SELF-ADJUSTING ARRANGEMENT FOR DRIVING A TRACKBOUND TOWING UNIT

BACKGROUND OF THE INVENTION

The present invention relates to an arrangement intended for driving a trackbound traction vehicle with carriages coupled thereto and with track inclinations of up to 1:4, and particularly to a drive arrangement which is self-adjusting in both the forward and rearward directions.

The Swedish Patent Application No. 8700667-2 teaches an arrangement of a similar kind intended for driving a trackbound traction unit with carriages at such track inclinations, although this arrangement is only self-adjusting in the forward direction of the traction unit. Consequently, when this known traction unit is driven in reverse, the drive wheels and the center rail of the drive arrangement are subjected to considerable wear and the pressure and/or driving force exerted by the drive wheels of the arrangement is reduced, and the risk of the traction unit being derailed is increased when, for instance, there is a fault in the tracks or rails or when the center rail of the drive arrangement is warped or twisted.

SUMMARY OF THE INVENTION

The object of the present invention is to provide an arrangement for driving a trackbound traction unit which is self-adjusting in both the forward and rearward direction of movement, thereby to overcome the drawbacks of known arrangements of this kind when driving the traction unit in reverse.

BRIEF DESCRIPTION OF THE DRAWING

The invention will now be described in more detail with reference to an exemplifying, preferred embodiment thereof and with reference to the accompanying drawings, in which.

DETAILED DESCRIPTION

Figure 1:
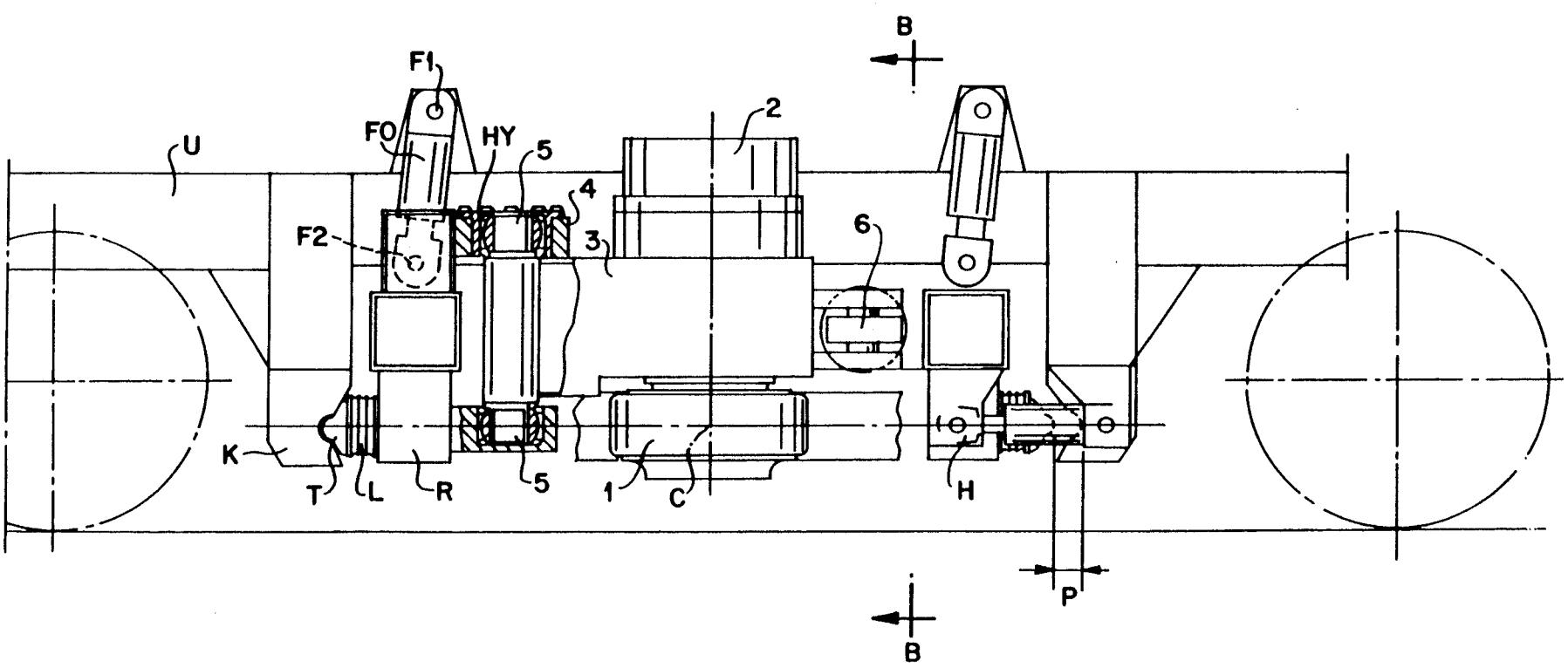
FIG. 1 is a longitudinal sectional view of a trackbound traction unit provided with a drive arrangement provided in accordance with principles of the present invention, this view being taken on the line A—A of FIG. 2.
Figure 2:
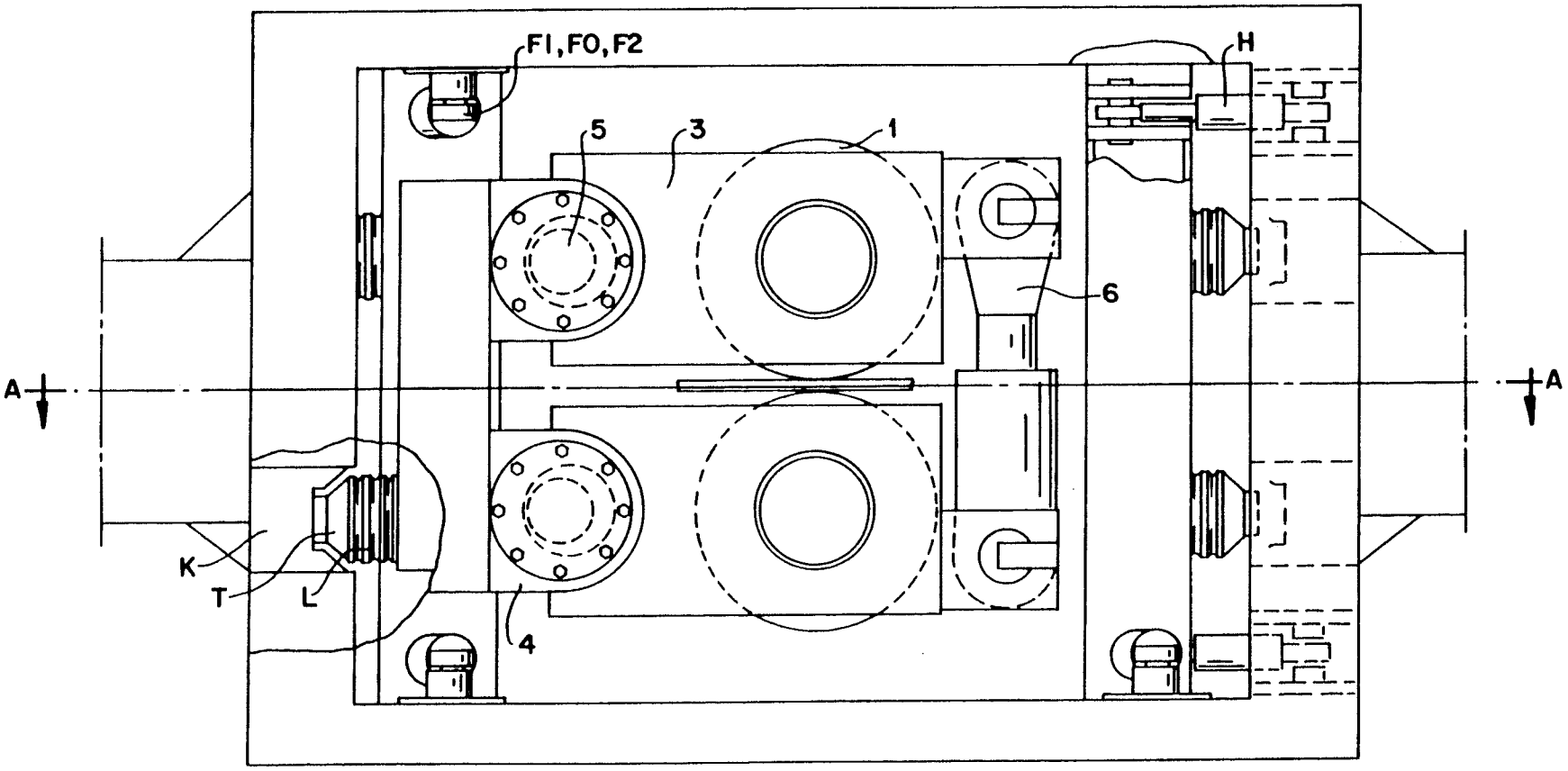
FIG. 2 is a top plan view of the traction unit shown in FIG. 1.
Figure 3:
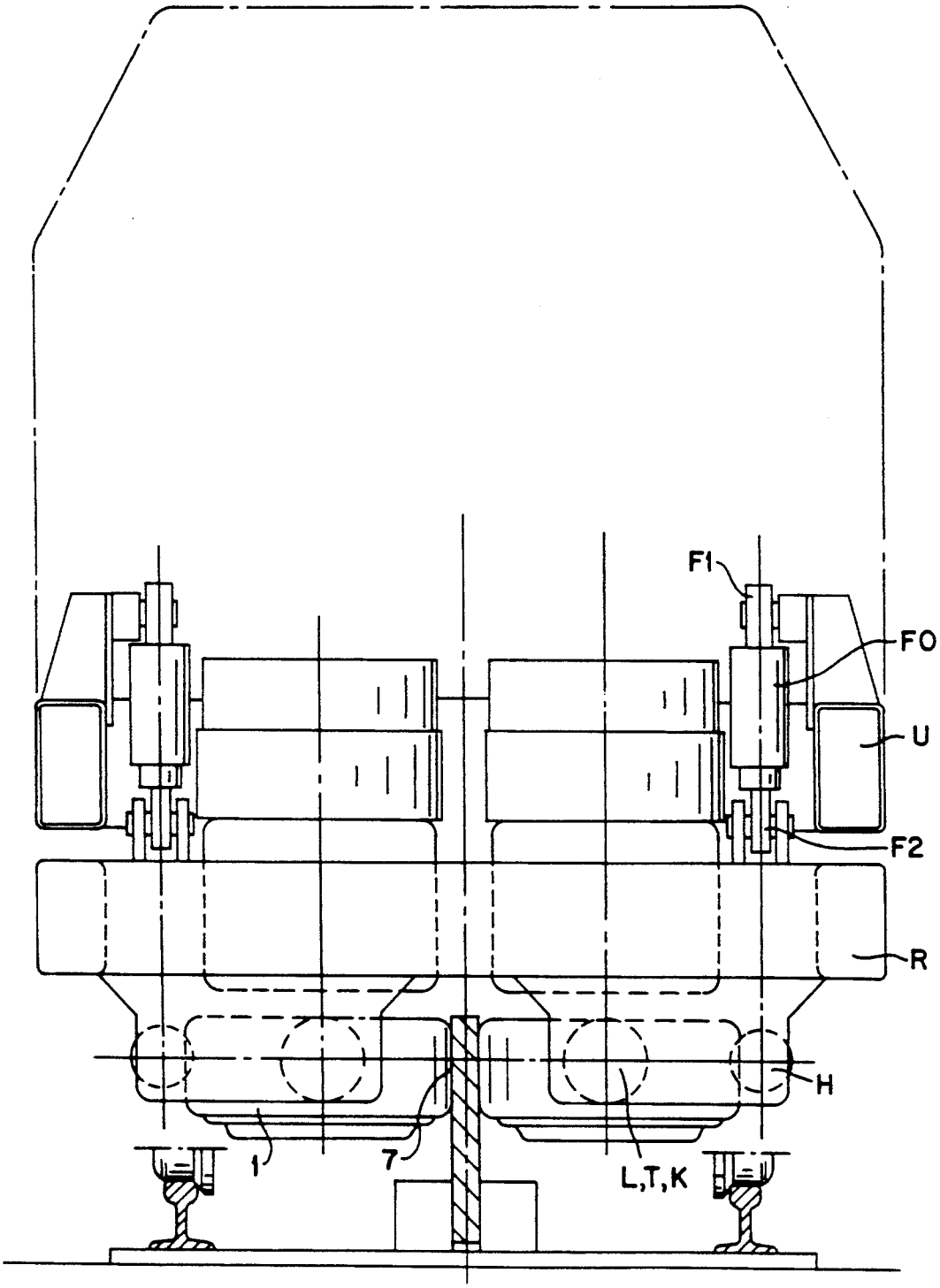
FIG. 3 is a cross-sectional view of the traction unit and drive arrangement, taken on the line B—B of FIG. 1.

As will be seen from the drawings and from FIGS. 1, 2 and 3 in particular, the illustrated embodiment of the drive arrangement of the present invention includes, in a known manner, at least two drive wheels 1 with associated transmissions 2, two carrier arms 3 which extend substantially parallel with the length direction of the traction unit and at one end of which drive wheels are journalled, a holder 4 in which the other end of the carrier arms is pivotally mounted by means of spherical bearings 5, a hydraulic clamping piston-cylinder device 6 which is connected to the firstmentioned ends of said carrier arms, and a rail 7 which is fixedly mounted on the supporting surface in the center of the track. The carrier arms 3 are substantially perpendicular to the geometric axes of respective drive wheels 1 and are intended to pivot the drive wheels 1 into pressured abutment with the center rail 7, through the medium of the hydraulic piston-cylinder device 6. The drive arrangement of the invention also includes a frame R of substantially elongated rectangular configuration.

The holder 4 projects from the left short side (FIG. 2) of the frame and the frame is suspended from the chassis U of the trackbound traction unit by four resilient articulated piston-cylinder devices FO which are pivotally journalled at the top and at the bottom thereof by means of, e.g., spherical bearings, and which are attached to the chassis and to the frame at respective attachment points F1 and F2. Alternatively, the frame can be suspended from the chassis in telescopic rods sprung with the aid of springs.

The articulated piston-cylinder device FO are connected to a source of hydraulic pressure which is adapted so as to balance the frame R and hold the frame positioned substantially in a horizontal plane. The frame together with associated components will then behave as though it were weightless around this plane. Consequently, when the frame R is subjected to external forces acting in a vertical plane, the frame will move either upwards or downwards, depending on the directional sense of the external forces, within an interval limited by the length of working stroke of the articulated piston-cylinder devices or sprung telescopic rods FO.

The frame R of the illustrated embodiment is provided on both short sides thereof with a resiliently mounted pressure device T and, as a result of the aforedescribed suspension, is able to swing freely between support forks K within a region P defined by the support forks and having a length of about 50 mm, the pressure devices being configured so that they will be guided into respective support forks upon movement of the frame to the left or to the right in FIG. 2. Movement of the frame is determined by the direction in which the drive wheels rotate. When contact is established between the pressure devices T on one short side of the frame and the corresponding support forks K on the chassis U, pivot points TK (FIG. 4) are formed which transmit the drive force responsible for displacing the chassis, and therewith the trackbound traction unit, in the direction in which the drive wheels act. The pressure devices T are mounted resiliently in elastic rubber elements L, which as a result of their elasticity distribute the pressure forces exerted by the pressure devices T equally on both sides of the center line of the traction unit and also enable the frame R to tilt in a vertical plane both longitudinally and transversely of the traction unit.

If the traction unit is driven to the left in FIG. 2, the pressure devices T on the left short-side of the frame R will move into engagement with corresponding support forks K on the chassis U and therewith form pivot points TK. Corresponding pressure devices T on the other short-side of the frame are thus free from engagement with corresponding support forks K within the region P, which means that the frame R is free to tilt upwards or downwards in a vertical plane, both along and across the pivot thus formed.

In this starting position, the frame R is substantially parallel with the plane of the track, the pressure devices T, the support forks K and the center points C of the drive wheels 1 being located in one and the same plane substantially parallel with the track plane 7.

In the event of a deviation from the frame position in which the frame is substantially parallel with the plane of the track, for instance due to a track fault or a warped center rail, the frame R with the drive wheels will be pivoted, or rotated, by the vertical reaction drive-force component ($F_{DV}$) acting on the drive wheels (1) and/or by the substantially horizontal reaction pressure force ($F_{TH}$) acting on the drive wheels (1) to the height position on the rail 7 in which the total drive force of the drive wheels again acts pressingly in a direction towards the pivot point TK. Those force moments which result in pivotal movement of the frame cease when this height position is reached.

When the traction unit is driving in the opposite direction, i.e. to the right in FIG. 2, for instance when reversing said unit, the pressure devices T on the right short side of the frame move into engagement with corresponding support forks K on the chassis and there form pivot points TK, which means that the pressure devices on the left side of the frame are free from engagement with corresponding support forks. The same procedure as that described above takes place when the position of the frame deviates from the position in which the frame is substantially parallel with the plane of the track, for instance due to a track fault or a warped center rail.

Figure 4:
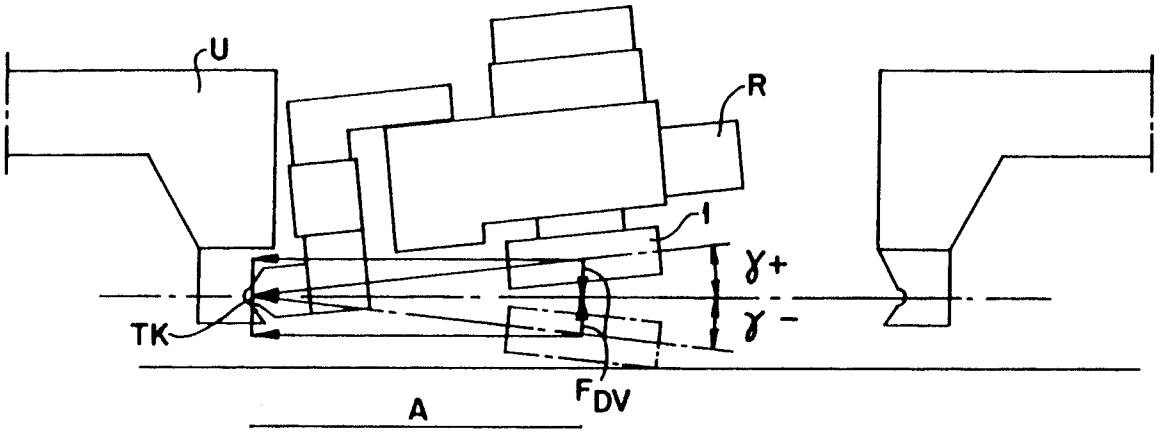
FIGS. 4 and 5 are respectively a side view and an end view of the drive arrangement with the drive wheels inclined in two mutually perpendicular vertical planes in relation to the track plane.
Figure 5:
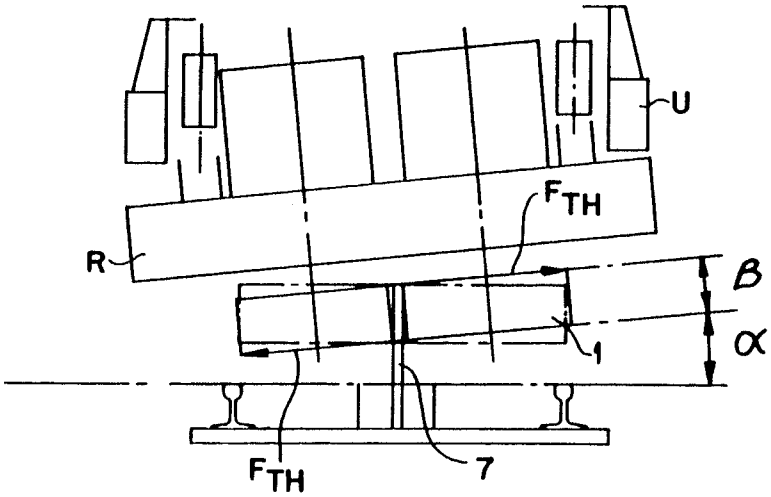

FIGS. 4 and 5 illustrate, by way of example, the manner in which the frame is returned automatically to the height position on the center rail in which the total drive force exerted by the drive wheels 1 acts in a direction towards the pivot points TK established when driving on one side.

Assuming, for sake of illustration, that the traction unit first moves along a fully horizontal track of which one rail, the left rail, abruptly begins to drop in relation to the other rail, which is still horizontal. The drive wheels will then be positioned slightly obliquely in relation to the center rail, partly in a vertical plane parallel with the rail (FIG. 4) and partly in a vertical plane perpendicular to the rail (FIG. 5).

At each positive or negative angular deviation between the rolling direction of the drive wheels and the track plane, there will then be produced in the vertical plane parallel with the rail 7 a vertical reaction drive-force component or a transverse force $F_{DV}$ on each drive wheel, this force being directed upwards or downwards depending on the angular deviation. This transverse force endeavours to rotate the frame R with the drive wheels to its starting position parallel with the track plane through the moment of force $F_{DV}.A$, where A is the distance between the mutual point of contact of the pressure devices and support forks, i.e. the pivot points TK, from the center points C of respective drive wheels 1, whereupon the transverse force ceases.

In the vertical plane perpendicular to the rail 7, on the other hand, in the event of an angular deviation $\alpha$ between the circular base or top surface of the drive wheels 1 and the track plane, each drive wheel 1 is subjected to a substantially horizontal reaction pressure-force or transverse force $FT_H$. This transverse force endeavours to rotate the frame R with the drive wheels via the elastic elements L, through the moment of force $F_{TH}.B$, where B is equal to the width or height of the drive wheel, such that the angular deviation $\alpha$ ceases and the transverse forces $F_{TH}$ return to the center points C of the drive wheels 1. The vertical reaction-pressure force components which also act on each drive wheel at the aforesaid angular deviation $\alpha$ are, however, negligible at the small angles concerned, i.e. angles of 1–2°.

The drive arrangement also includes two hydraulic holding piston-cylinder devices H which are pivotally connected to the frame R and to the chassis U and which function to ensure contact between the pressure devices T and the support forks K in the drive direction should the traction unit roll faster than the peripheral speed of the drive wheels 1 along the center rail 7, for instance due to gravity when rolling along an inclined plane, wherewith the support forks K on the chassis move away from the pressure device T on the frame. The holding piston-cylinder devices H can thus be used to maintain the pivotal connection in the drive direction, irrespective of the slope of the track plane. The holding piston-cylinder devices H are located substantially parallel with the long sides of the frame R. The pivotal connections of the piston-cylinder devices H with the frame and the chassis preferably have the form of spherical bearings, thereby enabling said piston-cylinder devices to tilt freely in a vertical plane, both transversely and longitudinally of the trackbound traction unit.

The pivot points formed by mutual coaction of the pressure devices T and the support forks K can also be locked firmly with the aid of (not shown) automatically operated hook locks which function to lock the pressure devices in the support forks.

The upper spherical bearing 5 of respective carrier arms 3 in the holder 4 is surrounded by a sleeve HY having eccentric outer and inner cylinder surfaces and is rotatable to enable the holder axes to be adjusted to a preset angle of inclination, therewith to compensate for elastic deformation of the carrier arms and the holder among other things, and thereby enabling the whole peripheral drive surface of the drive wheels to be brought into abutment with the center rail. The holder 4 is located on one short side of the frame R and is configured as two symmetrical parts which are formed integrally with the frame or which are fixedly connected thereto.

I claim:

1. An arrangement for driving a trackbound traction unit and being self-adjusting in both a forward and a rearward direction, which are opposed to one another longitudinally of said unit, comprising:

at least two drive wheels with associated transmissions;

two carrier arms having longitudinal axes are substantially parallel with the longitudinal direction of the traction unit and on which the drive wheels are journalled at one end thereof;

a holder in which another end of the carrier arms is pivotally journalled by means of spherical bearings;

a hydraulic piston-cylinder device which is connected to said one end of said carrier arms;

a rail which is fixedly mounted in the center of said track;

said carrier arms being substantially perpendicular to the geometric axes of said drive wheels and being arranged to swing said drive wheels into pressured abutment with said center rail via said hydraulic piston-cylinder device;

a substantially elongated rectangular frame from which said holder projects;

resilient devices from which said frame is pivotally suspended on a chassis of said traction unit;

coupling devices for resilient coaction between the frame and the chassis;

hydraulic holding piston-cylinder devices for coupling together said coupling devices when the traction unit is driven;

when driving the traction unit forwards or in reverse, selected ones of said coupling devices in the driving direction abut one another such as to form pivot points while remaining others of said coupling devices are disposed out of mutual engagement, said coupling devices and the center points of said drive wheels being located in a same plane, which is substantially parallel with the track plane, and said frame is free to tilt up or down in a vertical plane which is one of perpendicular to and parallel with the center rail; and in the event that a deviation of the rail position from the plane of the frame occurs in a driving state, the frame is rotated by at least one of a vertical reaction drive-force component acting on said drive wheels and a substantially horizontal reaction-pressure force acting on said drive wheels to the deviating position of the rail, in which position the total drive force of said drive wheels is directed towards said pivot points.

2. The arrangement according to claim 1, wherein:

said holder is located on one short-side of said frame and is configured as two symmetrical parts which are formed integrally with said frame.

3. The arrangement according to claim 1, wherein said resilient devices are at least four in number and are pivotally connected to said chassis and to said frame and form respective adjustable hydraulic articulated piston-cylinder devices.

4. The arrangement according to claim 3, wherein:

said resilient devices are pivotally connected to said chassis and to said frame via respective spherical bearings.

5. The arrangement according to claim 1, wherein:

said coupling devices are pressure devices and support forks which are resiliently mounted in elastic rubber elements; and said pressure devices are mounted on the short sides of said frame with corresponding support forks on a same level thereas in said chassis.

6. The arrangement according to claim 1, wherein:

said piston-cylinder devices are at least two in number and are pivotally connected to said frame and to said chassis, and are located substantially parallel with long sides of said frame.

7. The arrangement according to claim 6, wherein:

said piston-cylinder devices are pivotally connected to said frame and to said chassis via respective spherical bearings.

8. The arrangement according to claim 1, wherein:

said holder is located on one short-side of said frame and is configured as two symmetrical parts which are fixedly connected with said frame.

9. The arrangement according to claim 1, wherein:

said resilient devices are at least four in number and are pivotally connected to said chassis and to said frame and form respectively sprung telescopic rods.

10. The arrangement according to claim 9, wherein:

said resilient devices are pivotally connected to said chassis and to said frame via respective spherical bearings.

* * * * *